US006457221B1

(12) United States Patent
Park

(10) Patent No.: US 6,457,221 B1
(45) Date of Patent: Oct. 1, 2002

(54) MANUFACTURING METHOD OF ACTUATOR FOR INK JET PRINTER HEAD

(75) Inventor: Sung June Park, Suwon-Shi (KR)

(73) Assignee: Samsung Electronics Co., LTD, Kyungki-Do (KR)

( * ) Notice: Subject to any disclaimer, the term of this patent is extended or adjusted under 35 U.S.C. 154(b) by 0 days.

(21) Appl. No.: 09/553,124

(22) Filed: Apr. 19, 2000

(30) Foreign Application Priority Data

Dec. 10, 1999 (KR) ..... 99-56397

(51) Int. Cl.[7] ..... H04R 17/00
(52) U.S. Cl. ..... 29/25.35; 310/348
(58) Field of Search ..... 29/25.35; 310/311, 310/340, 348, 363, 364

(56) References Cited

U.S. PATENT DOCUMENTS 5,666,706 A * 9/1997 Tomita et al. ..... 29/25.35
5,771,555 A * 6/1998 Eda et al. ..... 29/25.35
6,021,552 A * 2/2000 Kishima et al. ..... 602/552

* cited by examiner

*Primary Examiner*—David J. Walczak
*Assistant Examiner*—Peter deVore
(74) *Attorney, Agent, or Firm*—Darby & Darby

(57) ABSTRACT

A method for manufacturing an actuator for ink jet printer head is disclosed. The method comprises steps of providing a silicon wafer; forming an etching stop layer on bottom side of said silicon wafer; forming a vibration plate made of silicic material; bonding said vibration plate onto bottom side of said etching stop layer by way of heat treatment; forming a chamber plate made of silicic material; forming a chamber on said chamber plate by way of full etching of said chamber plate; bonding said chamber plate where said chamber is formed, onto bottom side of the vibration plate by way of heat treatment; completing an actuator infrastructure by removing said silicon wafer; forming a lower electrode on said infrastructure; forming a piezoelectric/electrostrictive film which actuates when electrified, in a definite pattern upon said lower electrode; and forming an upper electrode upon said piezoelectric/electrostrictive film.

10 Claims, 16 Drawing Sheets

MANUFACTURING METHOD OF ACTUATOR FOR INK JET PRINTER HEAD

BACKGROUND OF THE INVENTION

1. Field of the Invention

The present invention relates to an actuator and particularly a manufacturing method of an actuator for ink jet printer head.

2. Description of the Prior Art

An ink jet printer head actuator using a piezoelectric substance is usually composed of an infrastructure made of vibration plate and chamber, a piezoelectric/electrostrictive film which undergoes mechanical deformation if electricity is applied as the film is fixed on vibration plate, and electrodes which transmit electricity to the piezoelectric/electrostrictive film.

Piezoelectric body of actuator has characteristics poling when electricity is applied. If electricity is supplied to upper and lower electrodes formed on and under piezoelectric substance under poling state, piezoelectric body located between electrodes undergoes mechanical deformation or vibrates with recycling of deformation and restoration.

In ink jet printer head, ink is jetted to the recording medium as vibration plate undergoes mechanical deformation thicknesswise if the piezoelectric substance of actuator vibrates.

Thus in ink jet printer head, infrastructure composed of chamber and vibration plate is an important factor for actuator operation.

In order to form actuator infrastructure using an electrostrictive substance, ordinarily chamber and vibration plate are formed mainly by half etching of wet etching process in case where metal is used as the material while three dimensional structure body is formed by sintering and pressing of a vibration sheet and a sheet of punching method in case where ceramic is used as the material.

But it is difficult to obtain vibration plate of wanted thickness by controlling the etching speed and time in case where actuator infrastructure is formed by half etching of metal while there is problem that precision and yield ratio are lowered at the processing step in case where actuator infrastructure is formed by ceramic punching and sinter-pressing.

SUMMARY OF THE INVENTION

Purpose of the present invention to solve the above problems is to provide a manufacturing method of actuator for ink jet printer head by bonding the chamber plate and the vibration plate composed of silicic material according to the direct silicon bonding.

The present invention to achieve the above purpose relates to a manufacturing method of actuator for ink jet printer head comprising steps of: providing a silicon wafer; forming an etching stop layer on bottom side of the silicon wafer; forming a vibration plate made of silicic material; bonding the vibration plate onto bottom side of the etching stop layer by way of heat treatment; forming a chamber plate made of silicic material; forming a chamber on the chamber plate by way of full etching of the chamber plate; bonding the chamber plate where the chamber is formed, onto bottom side of the vibration plate by way of heat treatment; completing an actuator infrastructure by removing the silicon wafer; forming a lower electrode on the infrastructure; forming a piezoelectric/electrostrictive film which actuates when electrified, in a definite pattern upon the lower electrode; and forming an upper electrode upon the piezoelectric/electrostrictive film.

Also the present invention relates to a manufacturing method of actuator for ink jet printer head comprising steps of : providing a silicon wafer; forming an etching stop layer on bottom side of the silicon wafer; forming a vibration plate made of silicic material; bonding the vibration plate onto bottom side of the etching stop layer by way of heat treatment; forming a chamber plate made of silicic material; forming a chamber on the chamber plate by way of etching of the chamber plate; forming a channel in lower part of the chamber by etching the chamber plate remaining at lower part of the chamber; bonding the chamber plate where the chamber and the channel are formed, onto bottom side of the vibration plate by way of heat treatment; completing an actuator infrastructure by removing the silicon wafer; forming a lower electrode on the infrastructure; forming a piezoelectric/electrostrictive film which actuates when electrified, in a definite pattern upon the lower electrode; and forming an upper electrode upon the piezoelectric/electrostrictive film.

DETAILED DESCRIPTION

Figure 1:
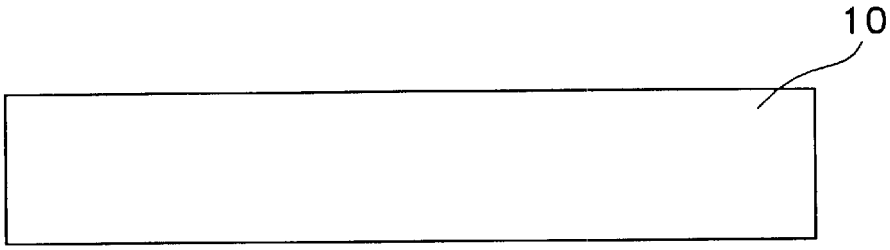
FIG. 1 to FIG. 11 are flow diagrams showing an example of the present invention.

The manufacturing method of actuator for ink jet printer head of the present invention is explained in detail hereunder.

At first a silicon wafer is prepared to bond the vibration plate. It is preferable to use silicon wafer 100–500 $\mu$m thick, which plays role to fix vibration plate in the subsequent process.

Etching stop layer is formed on bottom side of prepared silicon wafer. It is preferable to form silicon oxide film ($SiO_2$) or silicon nitride film ($Si_3N_4$) for the etching stop layer. Usually silicon oxide film is formed by heat treatment of bottom side of silicon wafer while silicon nitride film is formed by nitriding treatment of bottom side of silicon wafer. The formed silicon oxide film or silicon nitride film becomes bond interface that bonds with vibration plate and will function as the etching stop layer when etching the silicon wafer in subsequent process.

Vibration plate to bond to silicon wafer is separately formed. Silicic material of silicon (Si), silicon carbide (SiC), polysilicon (poly-Si) etc. is used for vibration plate material. It is preferable to form the vibration plate 5–10 $\mu$m thick.

When it is difficult to form thin vibration plate, a vibration plate of wanted thickness may be formed by lapping and polishing after bonding a thick vibration plate to the silicon wafer.

Vibration plate is bonded with silicon wafer where the etching stop layer is formed. Whence the etching stop layer formed on bottom side of silicon wafer shall be bonded with vibration plate.

Bonding of the vibration plate and the etching stop layer is by way of heat treatment where high temperature heat treatment above 1,000° C. is required because stuff materials are silicic. At this time of heat treatment, a pressure may be applied to facilitate bonding. And when such a high temperature heat treatment processing is difficult, heat treatment temperature may be lowered to 400–500° C. by applying a direct current electricity field within 800 DVC between upper and lower wafers at time of bonding.

Whence adhesion is by direct bonding between silicon atoms because the vibration plate and the etching stop layer are altogether composed of silicic material.

Chamber plate is separately formed. Silicic material of silicon, silicon carbide etc. is used for chamber plate material and it is preferable to use it manufactured as wafer type.

Whence chamber plate may be formed where chamber only is formed or where chamber and channel are integratedly formed.

In case when chamber only is formed there, it is formed on chamber plate by way of full etching of dry or wet etching method of silicic material of wafer type that will be the chamber plate. In case of dry etching method, there is advantage that chamber cross section is formed in perpendicular mode, while in case of wet etching method, when fixing onto ink jet printer head infrastructure, there is advantage to increase adhesive surface area between the chamber plate and the infrastructure because chamber cross section is formed in slant mode. Also the method has merit that it is advantageous in ink jetting because ink pressure by vibration plate flexing is applied in direction of channel.

On the other hand in case when chamber and channel are to be formed integratedly, firstly silicic material that will be the chamber plate is etched to form chamber, then chamber plate remaining at lower part of the chamber is etched to form channel in the lower part of the chamber. Whence either dry or wet etching method may be used to etch chamber but it is preferable to form it by wet etching method while it is preferable to form channel by dry etching method. In the case of forming chamber and channel integratedly, array error and bad adhesion may be prevented that may arise in case when chamber plate and channel plate are separately bonded. Vibration plate fixed onto silicon wafer is bonded with chamber plate formed separately. Bonding of vibration plate and chamber plate is by heat treatment where high temperature heat treatment above 1,000° C. is required because stuff materials are silicic. At this time also of heat treatment, a pressure may be applied to facilitate bonding, and heat treatment temperature may be lowered to 400–500° C. by applying a direct current electricity field within 800 DVC between upper and lower wafers at time of bonding.

At this time also adhesion between vibration plate and chamber plate is by direct bonding between silicon atoms because the vibration plate and the chamber plate are altogether composed of silicic material.

Then silicon wafer is removed after adhesion of the vibration plate and the chamber plate. The silicon wafer is removed by lapping or etching or by etching after lapping. In case of the etching, etching degree can be controlled because etching is interrupted at the etching stop layer formed on bottom side of silicon wafer.

Ink jet printer head actuator infrastructure is completed by the above procedure.

Lower electrode is formed on the vibration plate. Conductive metal of gold (Au), silver (Ag), platinum (Pt), aluminum (Al), nickel (Ni), copper (Cu), alloy of silver and palladium (Pd) etc. is used for the lower electrode material which is formed using method of vacuum vapor deposition, sputtering or screen printing etc.

There is formed on the lower electrode a piezoelectric/electrostrictive film which actuates when electrified. The piezoelectric/electrostrictive film can be formed by usual methods, among the typical of which there are method forming by heat treatment after forming a film by method of screen printing etc. after shaping a paste from piezoelectric/electrostrictive ceramic powder, and method patterning by etching after bonding a piezoelectric/electrostrictive film of thin plate type.

Upper electrode is formed in a definite pattern upon the piezoelectric/electrostrictive film. The upperelectrode is formed by same stuff and method as for the lower electrode explained above. Whole actuator is completed by forming the upper electrode.

Completed actuator may be used as it is or may bestow hydrophilicity on surface of chamber plate and vibration plate that contacts with ink, by way of forming a silicon oxide membrane on the surface by thermal oxidation of silicic material.

The present invention as explained above is easy and simple in processing because structure is formed by direct silicon bonding and because there is no need of separate insulation layer formation process because of using silicic material for vibration plate and also the invention makes effect to facilitate hydrophilation treatment.

And because silicic material is used as stuff, high temperature processing is feasible, the product is excellent in oxidation resistance, process accuracy, that is integration degree, can be heightened, and hydrophilation treatment becomes easy.

Now practice examples of the present invention are explained with reference to drawings. But the following application examples are only illustrations of the present invention and do not confine extent of the present invention.

Figure 2:
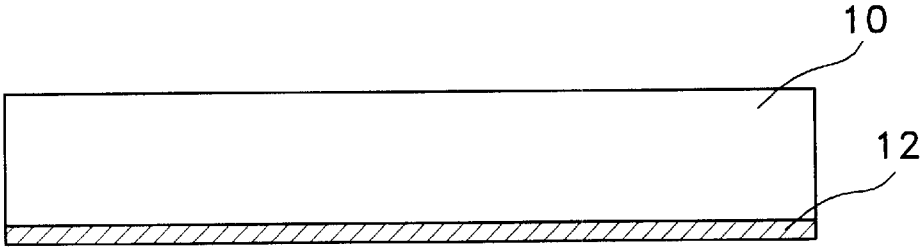
Figure 3:
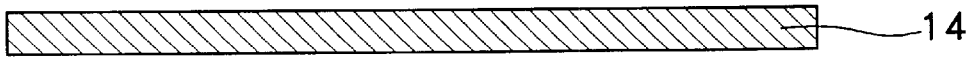
Figure 4:
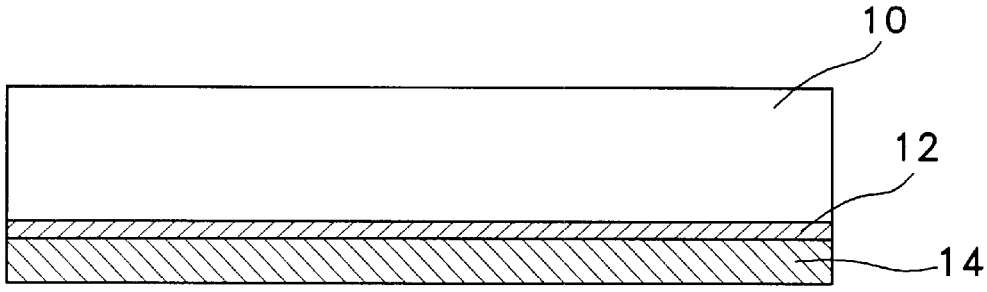
Figure 5:
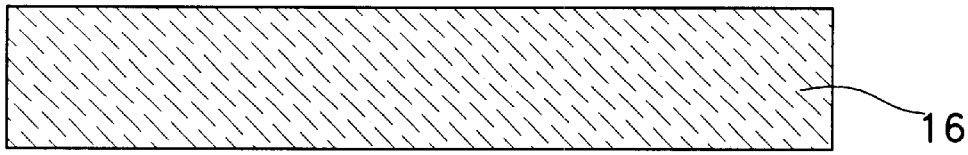
Figure 6:
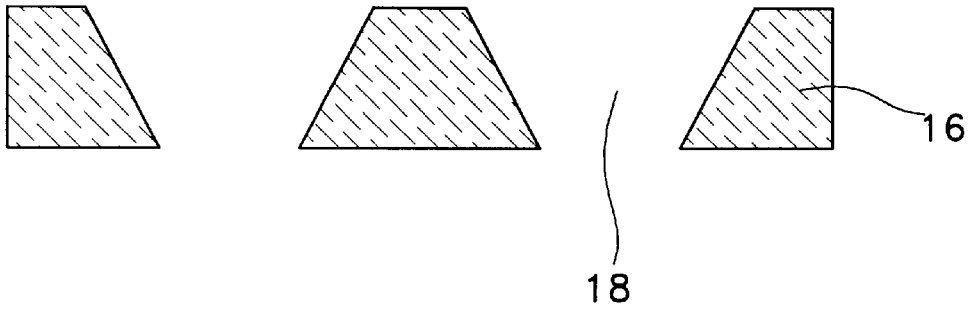
Figure 7:
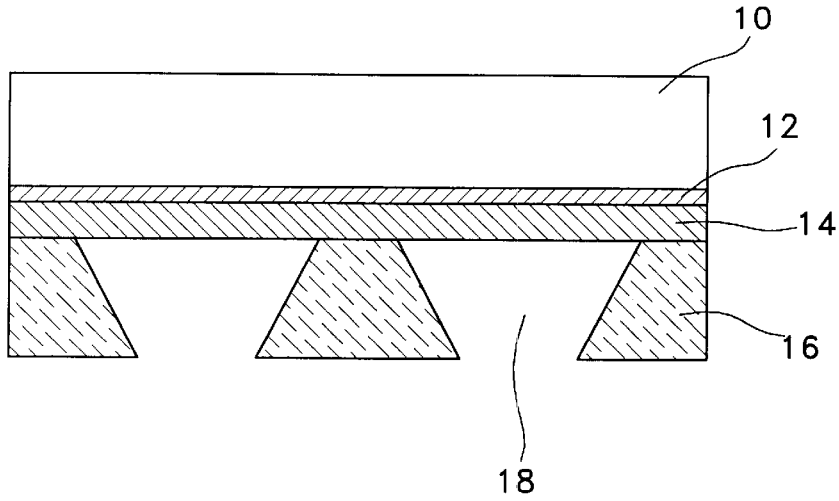
Figure 8:
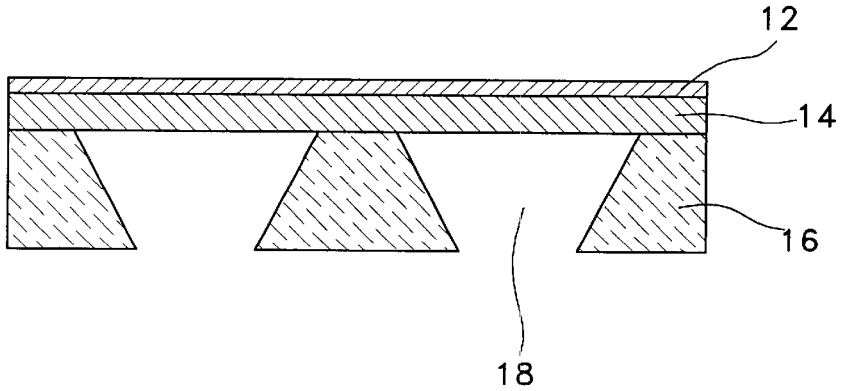
Figure 9:
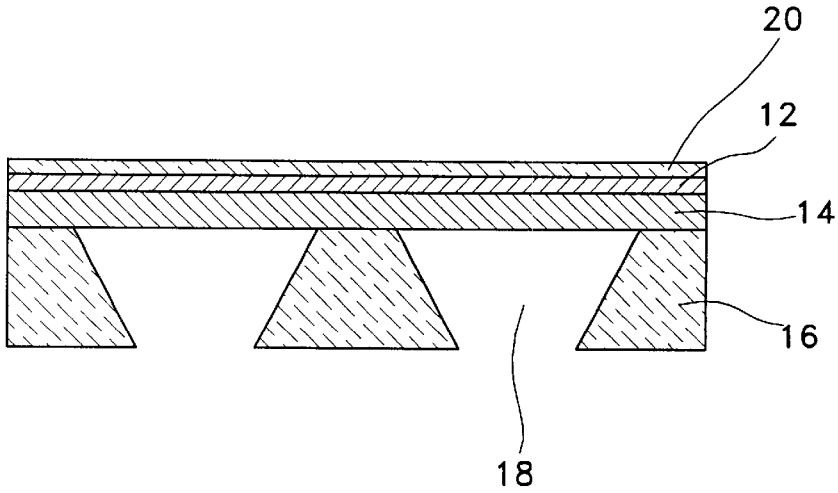
Figure 10:
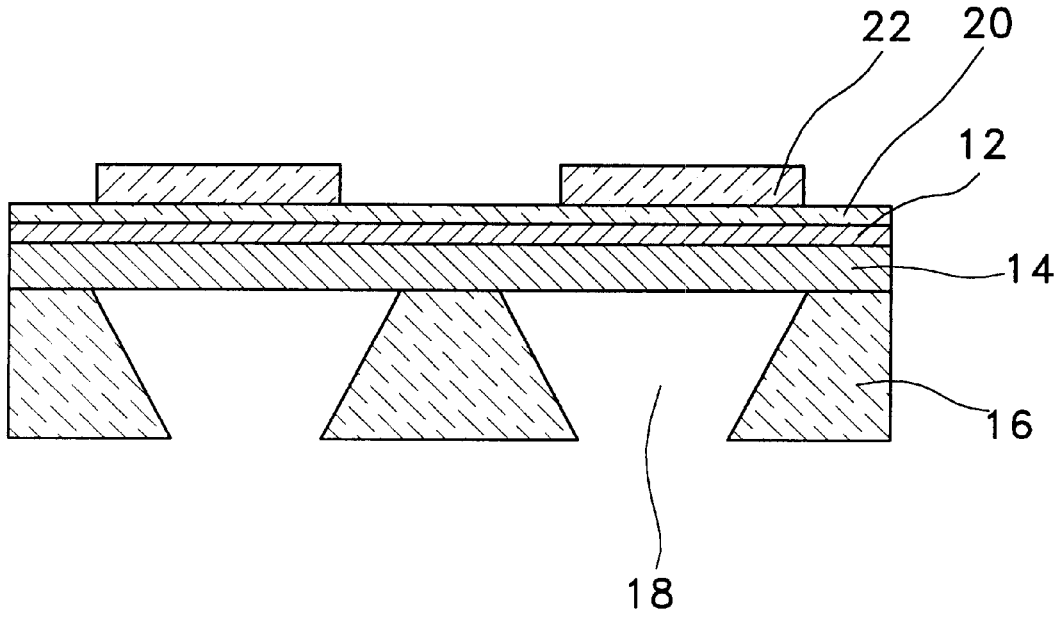
Figure 11:
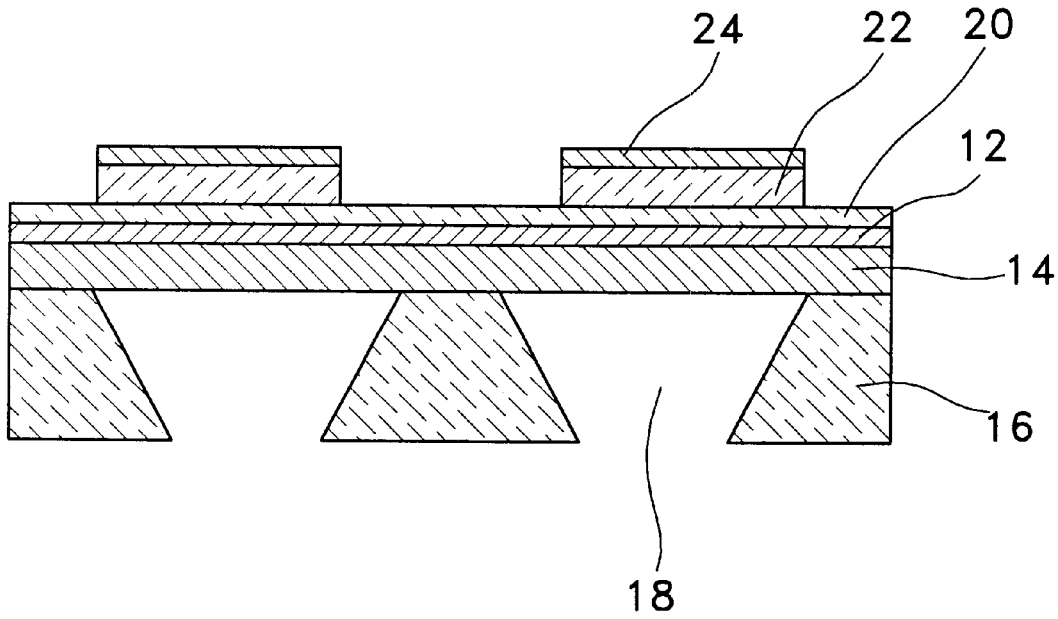

FIG. 1 through FIG. 11 show process flow of an example of the present invention.

Etching stop layer (12) is formed on bottom side of silicon wafer (10). Separately formed silicic type vibration plate (14) is fixed onto bottom side of the etching stop layer (12).

Chamber (18) is formed by full etching by wet etching method after forming the chamber plate (16) with silicic stuff. The chamber plate (16) where chamber (18) has been formed is fixed under vibration plate (14). Actuator infrastructure is completed by removing the silicon wafer (10) by way of etching after bonding chamber plate (16) with vibration plate (14).

Actuator is completed by forming lower electrode (20), piezoelectric/electrostrictive film (22) and upper electrode (24) on completed infrastructure.

Figure 12:
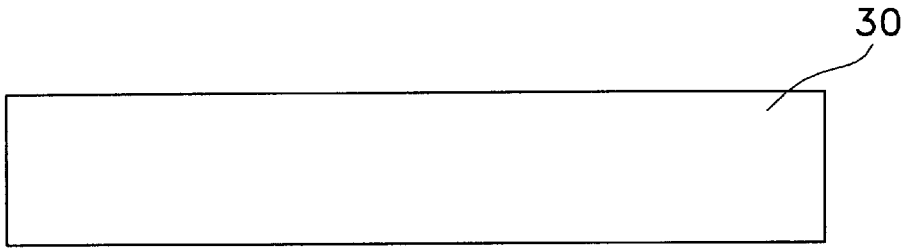
FIG. 12 to FIG. 23 are flow diagrams showing another example of the present invention.
Figure 13:
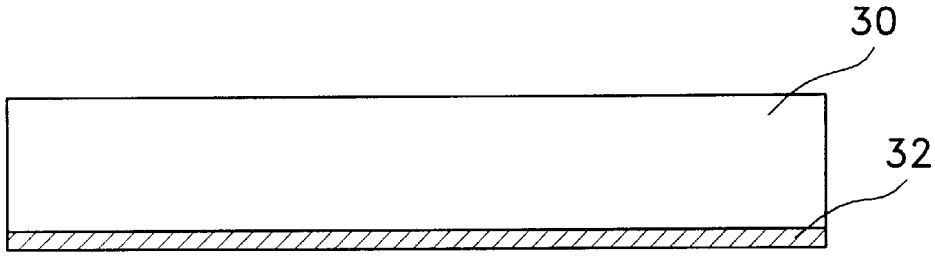
Figure 14:
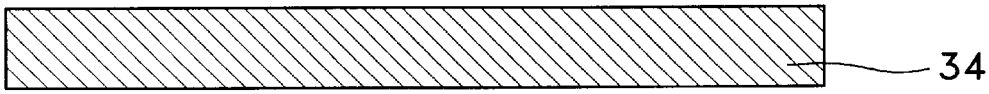
Figure 15:
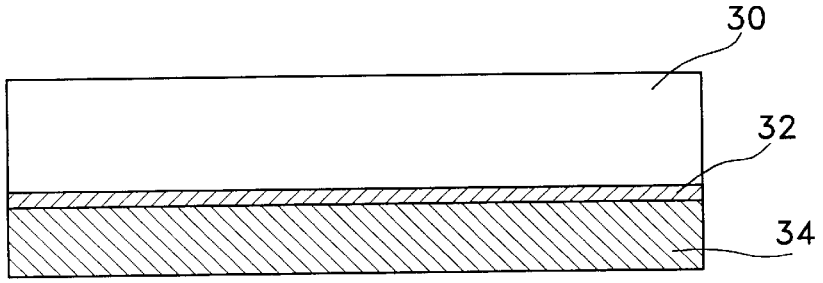
Figure 16:
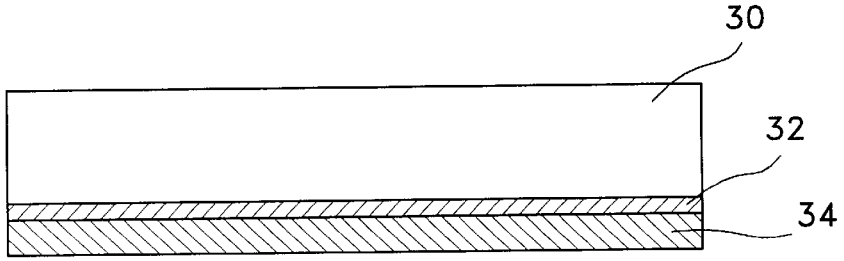
Figure 17:
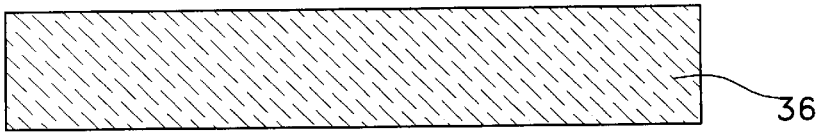
Figure 18:
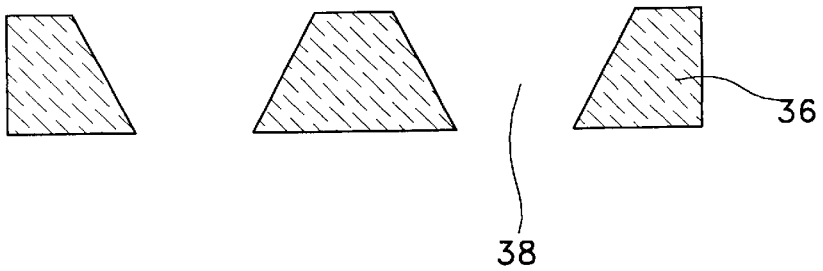
Figure 19:
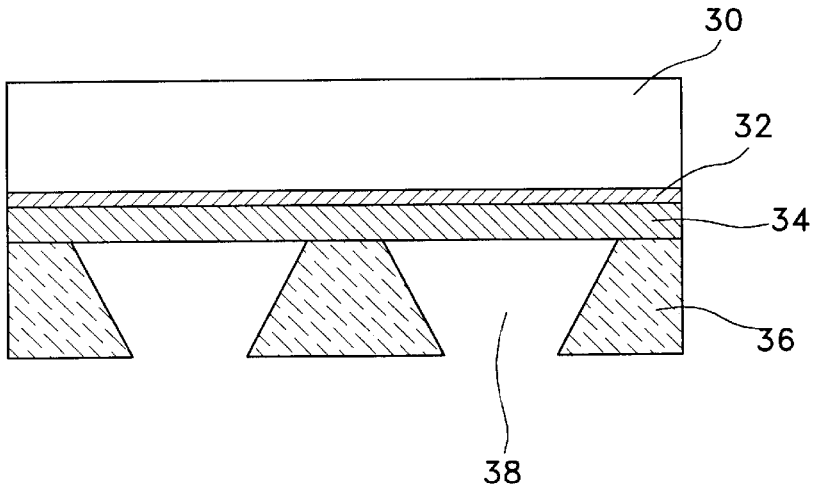
Figure 20:
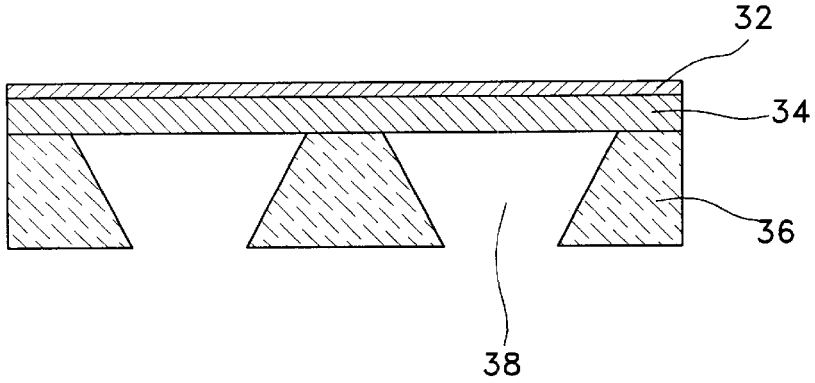
Figure 21:
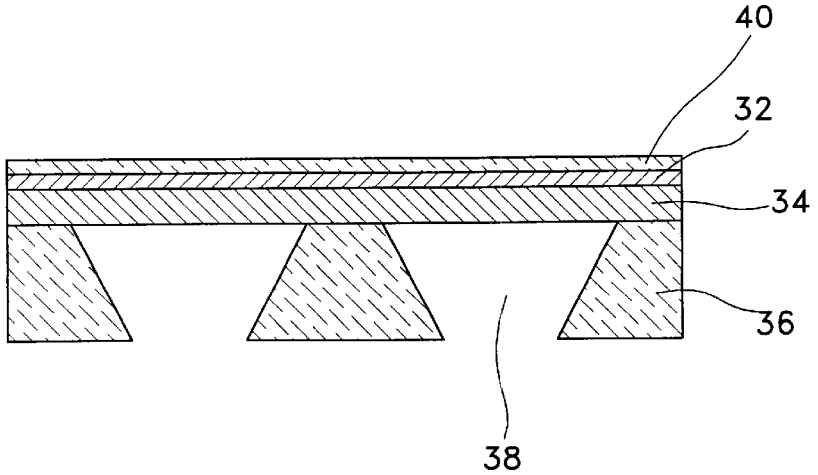
Figure 22:
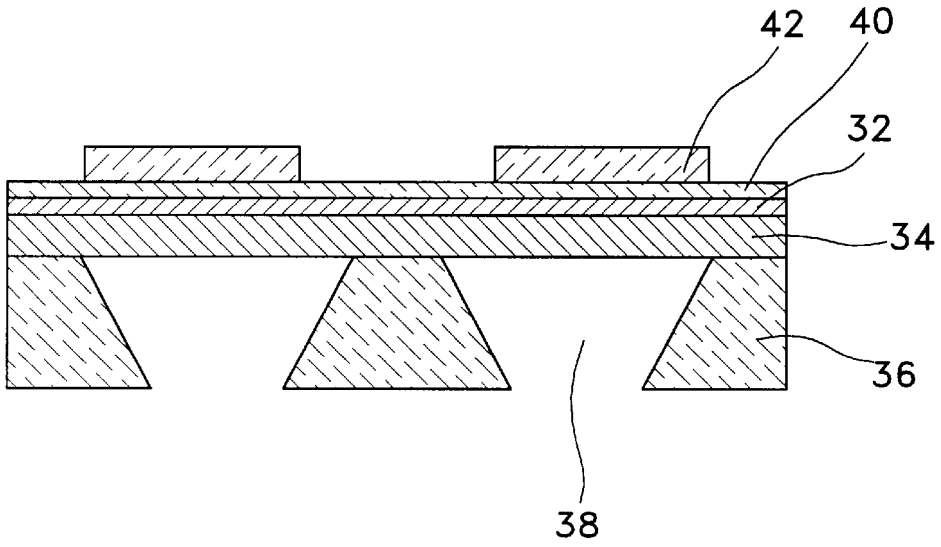
Figure 23:
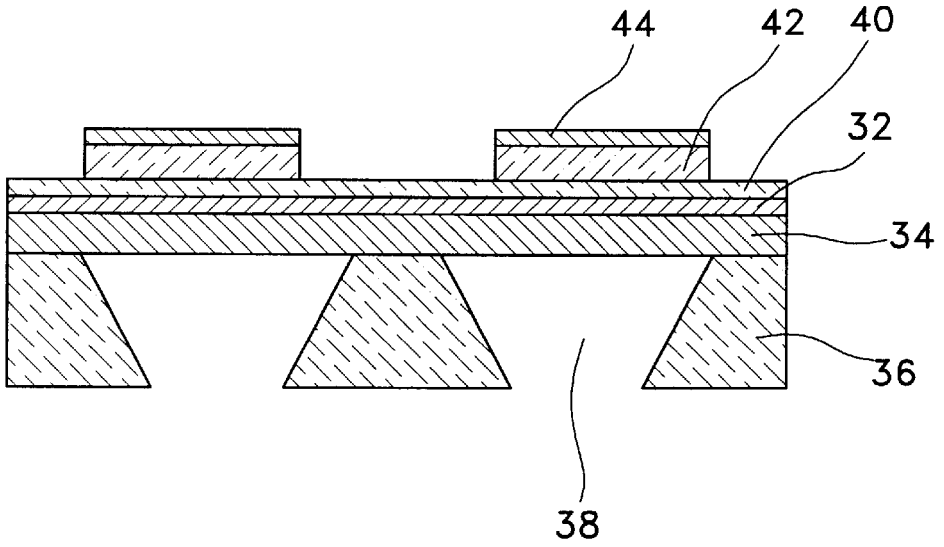

FIG. 12 through FIG. 23 show process flow of another example of the present invention.

Etching stop layer (32) is formed under silicon wafer (30). Silicic type vibration plate (34) is fixed under the etching stop layer (32). The fixed vibration plate (34) is finished by lapping and polishing to make out wanted thickness of vibration plate.

Chamber (38) is formed by full etching by wet etching method after forming the chamber plate (36) with silicic stuff. The chamber plate (36) where chamber (38) has been formed is fixed under vibration plate (34). Actuator infrastructure is completed by removing the silicon wafer (30) by way of etching after bonding chamber plate (36) with vibration plate (34).

Actuator is completed by forming lower electrode (40), piezoelectric/electrostrictive film (42) and upper electrode (44) on completed infrastructure.

Figure 24:
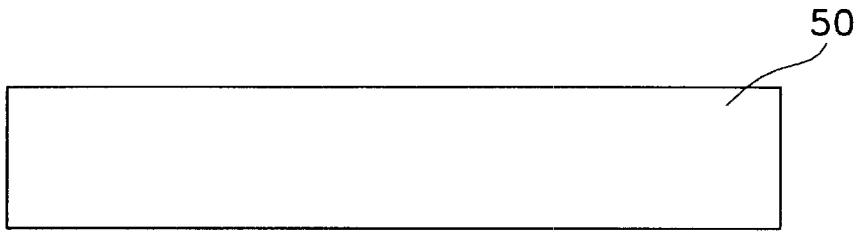
FIG. 24 to FIG. 34 are flow diagrams showing another example of the present invention.
Figure 25:
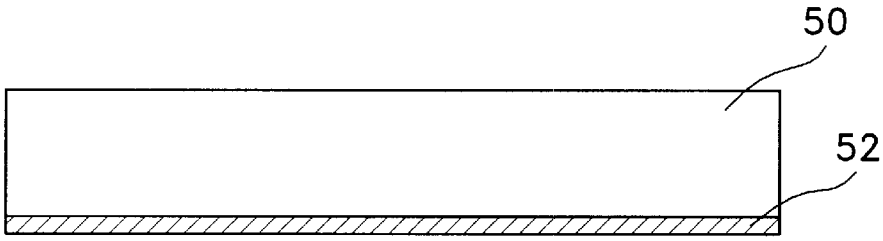
Figure 26:
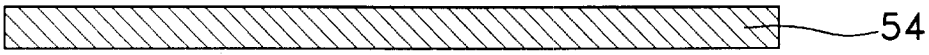
Figure 27:
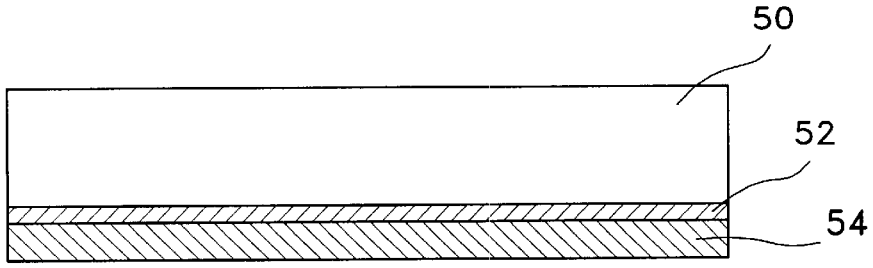
Figure 28:
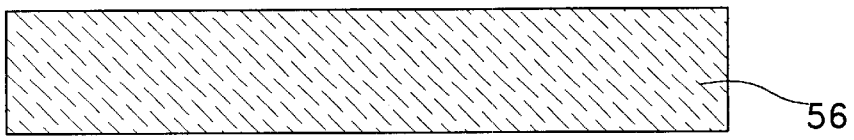
Figure 29:
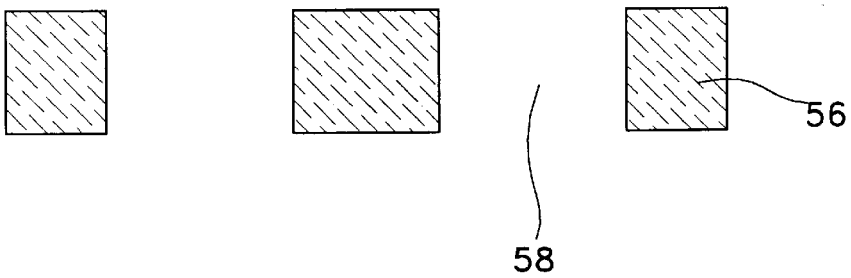
Figure 30:
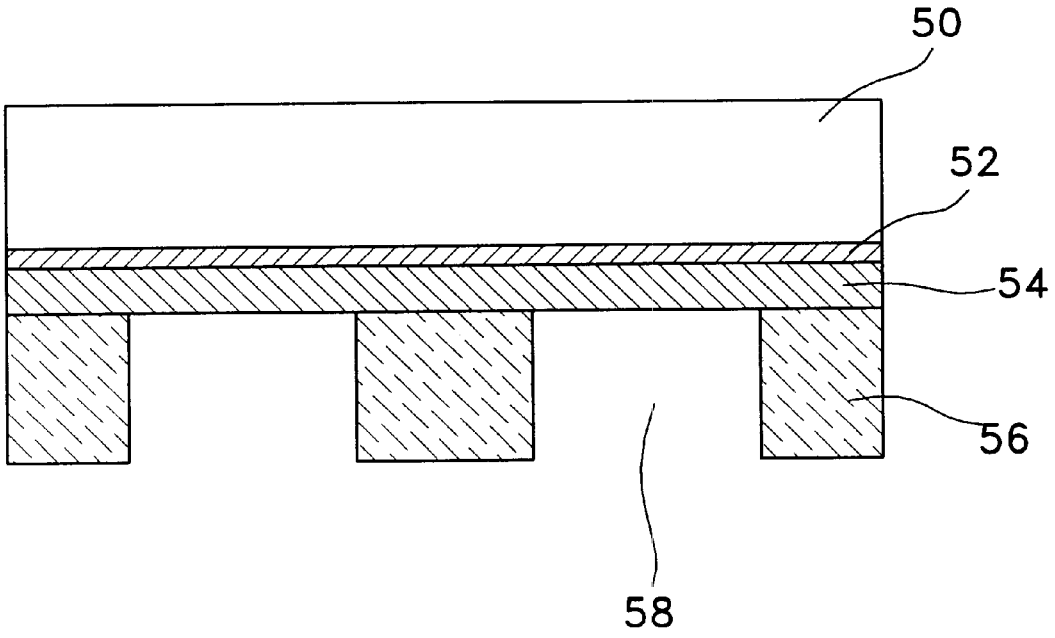
Figure 31:
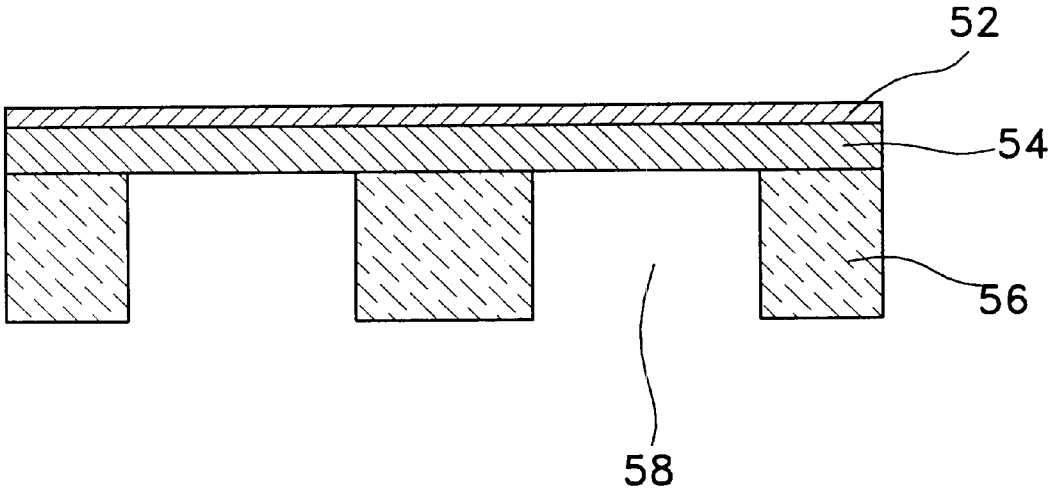
Figure 32:
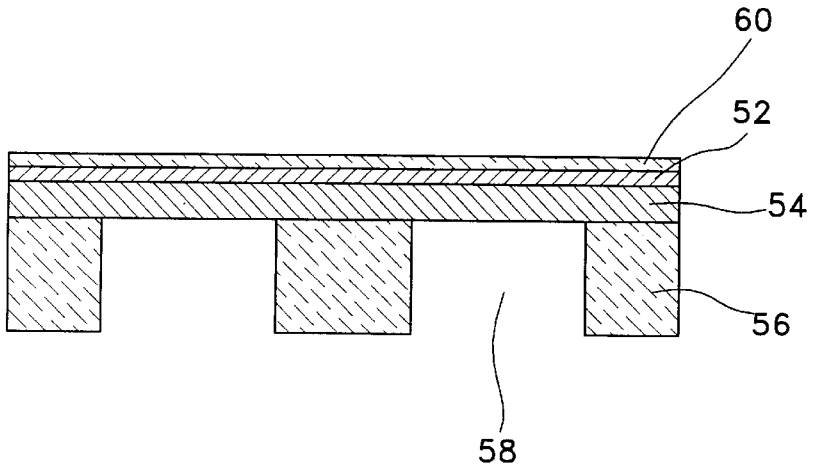
Figure 33:
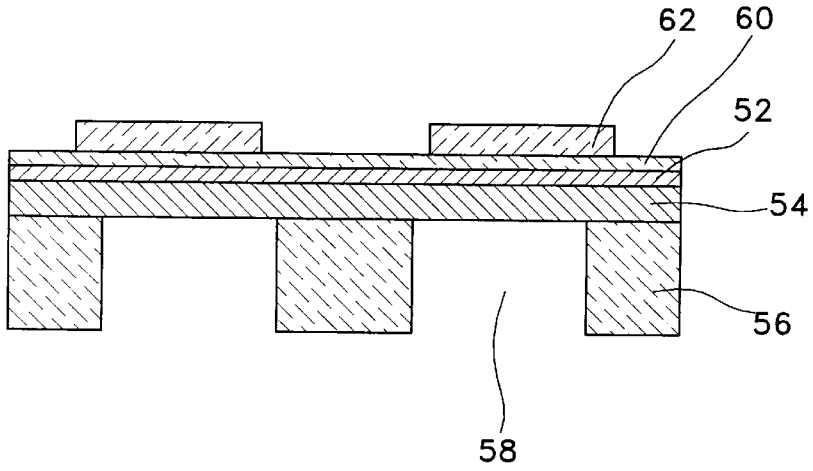
Figure 34:
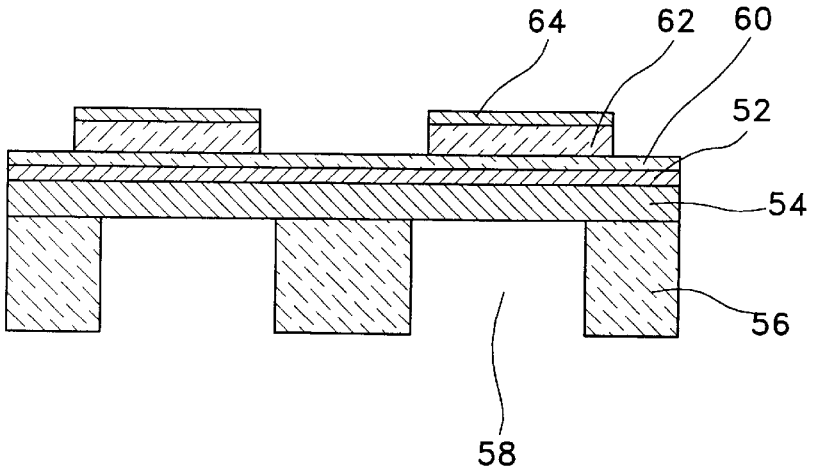

FIG. 24 through FIG. 34 show process flow of another example of the present invention.

Etching stop layer (52) is formed on bottom side of silicon wafer (50). Separately formed silicic type vibration plate (54) is fixed onto bottom side of the etching stop layer (52).

Chamber (58) is formed by full etching by dry etching method after forming the chamber plate (56) with silicic stuff. The chamber plate (56) where chamber (58) has been formed is fixed under vibration plate (54). Silicon wafer (50) is removed by lapping and etching after bonding chamber plate (56) with vibration plate (54). Thus actuator infrastructure is completed by removing the silicon wafer (50).

Actuator is completed by forming lower electrode (60), piezoelectric/electrostrictive film (62) and upper electrode (64) upon vibration plate (54).

Figure 35:
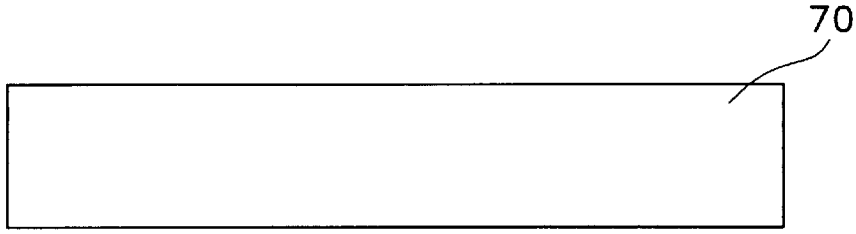
FIG. 35 to FIG. 46 are flow diagrams showing more other example of the present invention.
Figure 36:
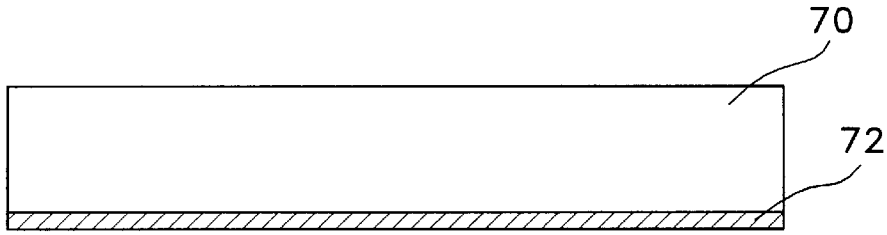
Figure 37:
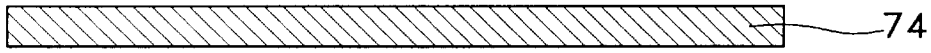
Figure 38:
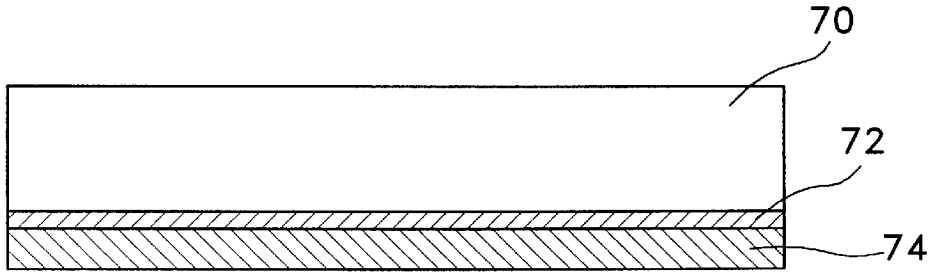
Figure 39:
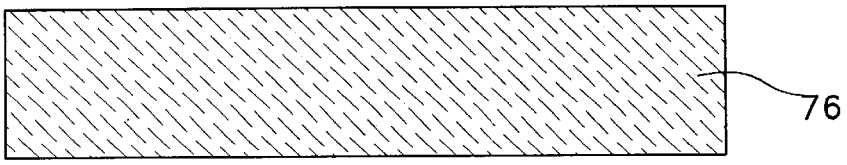
Figure 40:
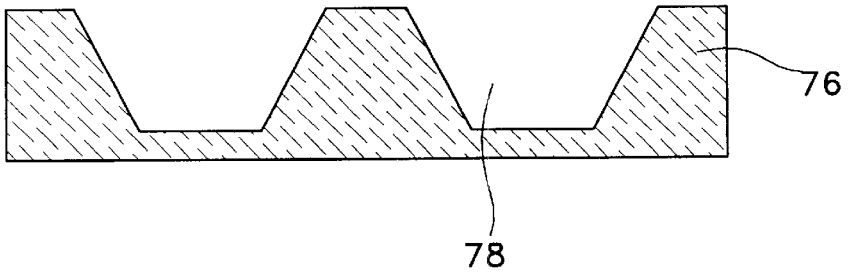
Figure 41:
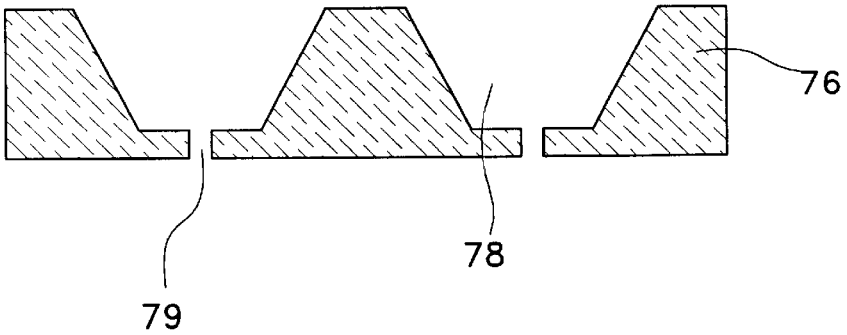
Figure 42:
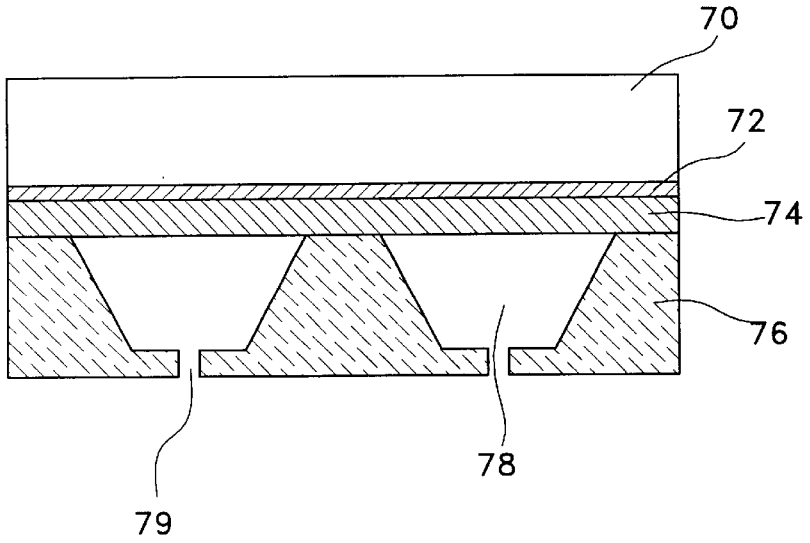
Figure 43:
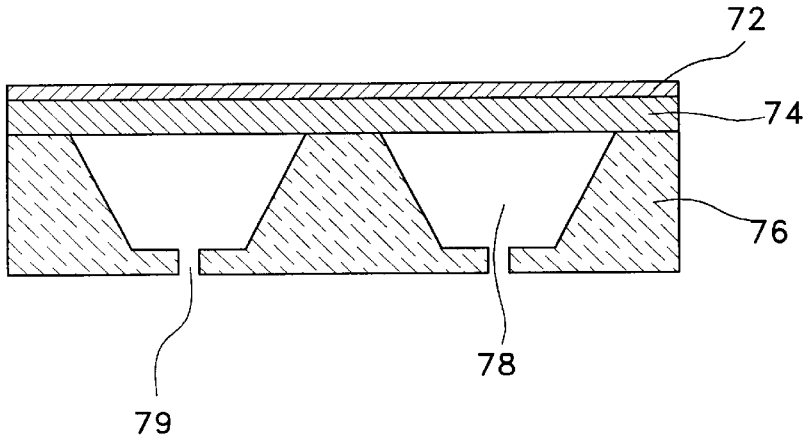
Figure 44:
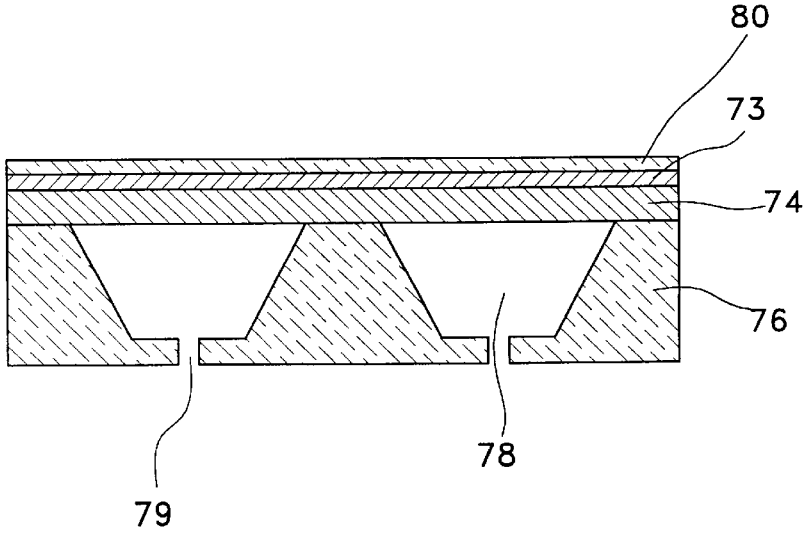
Figure 45:
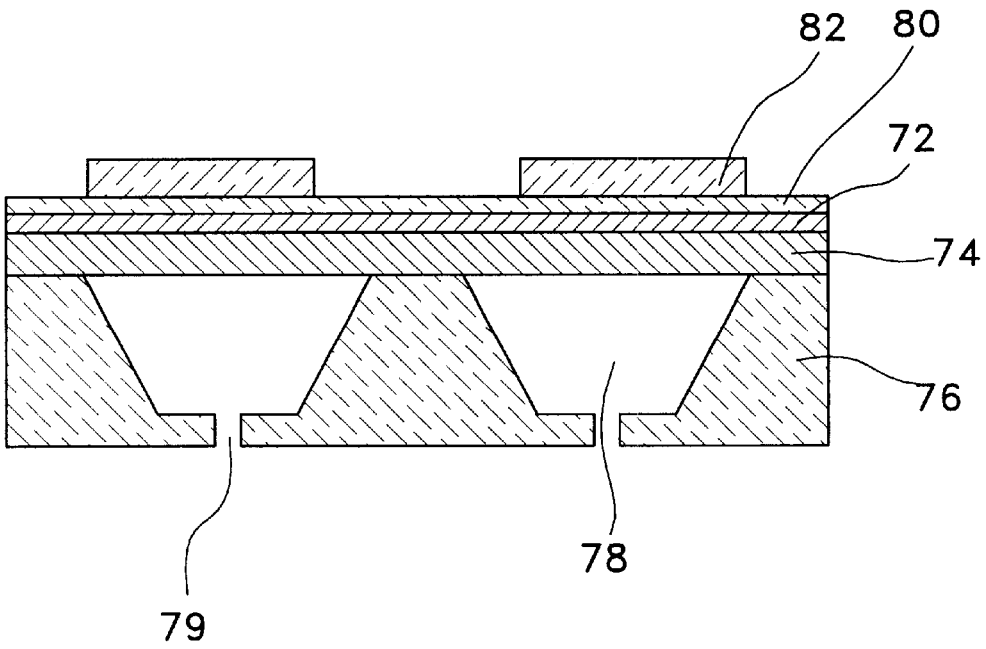
Figure 46:
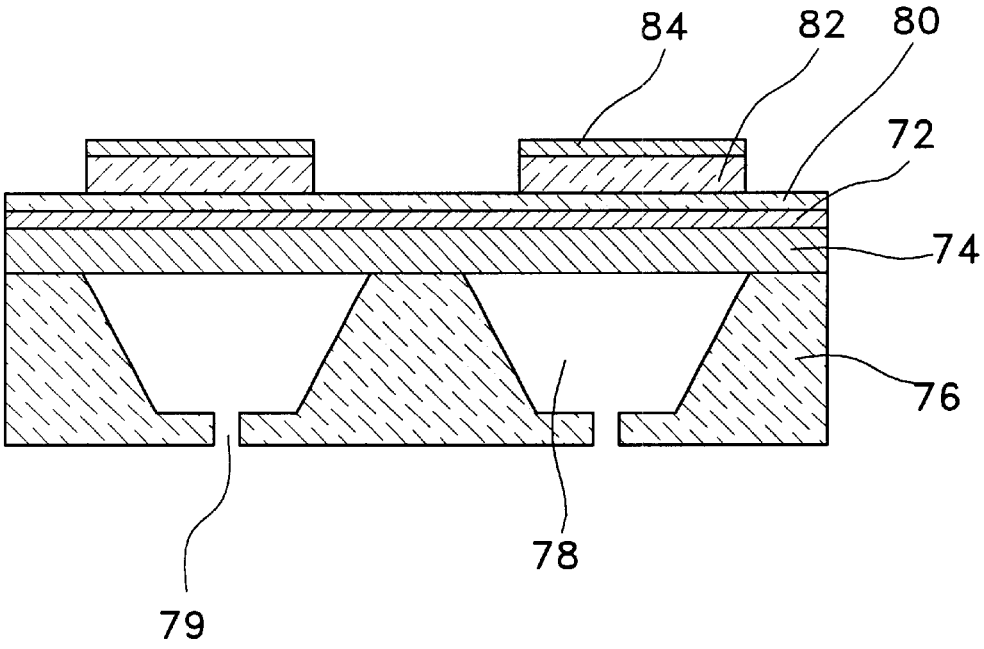

FIG. 35 through FIG. 46 show process flow of more other example of the present invention.

Stop layer of etching (72) is formed on bottom side of silicon wafer (70). Separately formed silicic type vibration plate (74) is fixed under the etching stop layer (72).

Chamber (78) is formed by wet etching and the bottom part is again dry etched to form channel (79). The chamber plate (76) where chamber (78) and channel (79) have been formed is fixed under vibration plate (74). Actuator infrastructure is completed by removing the silicon wafer (70) by way of etching after bonding chamber plate (76) with vibration plate (74).

Actuator is completed by forming lower electrode (80), piezoelectric/electrostrictive film (82) and upper electrode (84) on completed infrastructure.

What is claimed is:

1. A manufacturing method of actuator for ink jet printer head comprising steps of providing a silicon wafer;

forming an etching stop layer on bottom side of said silicon wafer;

forming a vibration plate made of silicic material;

bonding said vibration plate onto bottom side of said etching stop layer by way of heat treatment;

forming a chamber plate made of silicic material;

forming a chamber on said chamber plate by way of full etching of said chamber plate;

bonding said chamber plate where said chamber is formed, onto bottom side of the vibration plate by way of heat treatment;

completing an actuator infrastructure by removing said silicon wafer;

forming a lower electrode on said infrastructure;

forming a piezoelectric/electrostrictive film which actuates when electrified, in a definite pattern upon said lower electrode; and forming an upper electrode upon said piezoelectric/electrostrictive film.

2. The method in claim 1, wherein said silicic material for said vibration plate is selected from silicon, silicon carbide and polysilicon.

3. The method in claim 1, wherein said vibration plate is formed 5–10 $\mu$m thick.

4. The method in claim 1, wherein said silicic material for said chamber plate is silicon or silicon carbide.

5. The method in claim 1, further comprising the step of hydrophile treating on the surface that contacts with ink in said actuator.

6. A manufacturing method of actuator for ink jet printer head comprising steps of providing a silicon wafer;

forming an etching stop layer on bottom side of said silicon wafer;

forming a vibration plate made of silicic material;

bonding said vibration plate onto bottom side of said etching stop layer by way of heat treatment;

forming a chamber plate made of silicic material;

forming a chamber on said chamber plate by way of etching of said chamber plate;

forming a channel in lower part of the chamber by etching said chamber plate remaining at lower part of said chamber;

bonding said chamber plate where said chamber and said channel are formed, onto bottom side of said vibration plate by way of heat treatment;

completing an actuator infrastructure by removing said silicon wafer;

forming a lower electrode on said infrastructure;

forming a piezoelectric/electrostrictive film which actuates when electrified, in a definite pattern upon said lower electrode; and forming an upper electrode upon said piezoelectric/electrostrictive film.

7. The method in claim 6, wherein said silicic material for said vibration plate is selected from silicon, silicon carbide and polysilicon.

8. The method in claim 6, wherein said vibration plate is formed 5–10 $\mu$m thick.

9. The method in claim 6, wherein said silicic material for chamber plate is silicon or silicon carbide.

10. The method in claim 6, further comprising the step of hydrophile treating on the surface that contacts with ink in said actuator.

* * * * *